US006971191B2

(12) United States Patent
Issler

(10) Patent No.: US 6,971,191 B2
(45) Date of Patent: Dec. 6, 2005

(54) METHOD AND APPARATUS FOR A SHOE HAVING IMPROVED CONSTRUCTION

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 68 days.

(21) Appl. No.: 10/449,365

(22) Filed: May 29, 2003

(65) Prior Publication Data

US 2004/0237341 A1 Dec. 2, 2004

(51) Int. Cl.[7] ..... A43B 9/04; A43B 9/10; A43B 9/12; A43B 15/00

(52) U.S. Cl. ..... 36/16; 36/22 R; 36/30 R; 12/142 T; 12/142 A; 12/142 RS

(58) Field of Search ..... 36/17 A, 14, 16, 36/19.5, 22 R, 30 A, 30 R; 12/142 E, 142 F, 12/142 T, 142 A, 142 RS

(56) References Cited

U.S. PATENT DOCUMENTS 967,572 A * 9/1910 Schwander ..... 36/16
1,270,218 A * 6/1918 Schwander ..... 36/16
2,288,615 A * 7/1942 Fausse ..... 36/22 R
2,349,866 A * 5/1944 Heck ..... 36/19.5
2,445,847 A * 7/1948 Curtis ..... 36/19.5
2,581,524 A * 1/1952 Ford ..... 36/19.5
2,744,340 A * 5/1956 Gerber ..... 12/142 S
2,900,649 A * 8/1959 Quinn ..... 12/142 F
6,226,894 B1 * 5/2001 Bray et al. ..... 36/17 A
6,560,900 B2 * 5/2003 Bray et al. ..... 36/17 A

* cited by examiner

*Primary Examiner*—Anthony Stashick
(74) *Attorney, Agent, or Firm*—St. Onge Steward Johnston & Reens LLC

(57) ABSTRACT

The invention relates to a method and apparatus for providing a shoe having an outsole having a top surface and a lip, where the lip extends around a portion of a periphery of the outsole and is above the top surface. The lip also has an inner surface facing inwardly and an outer surface facing outwardly. An upper is in contact with and secured to the outer surface of the lip. The inner surface of the lip is thereafter secured to the top surface for completing the shoe's attachment of the upper to the outsole.

21 Claims, 6 Drawing Sheets

METHOD AND APPARATUS FOR A SHOE HAVING IMPROVED CONSTRUCTION

FIELD OF THE INVENTION

The invention relates to a shoe having an improved shoe construction, resulting in reduced manufacturing costs.

BACKGROUND OF THE INVENTION

A variety of different shoe constructions are used by the footwear industry. For the most part, each shoe construction has characteristics that make it particularly well-suited for specific applications. For example, some shoe constructions are selected for their durability, others for their flexibility and comfort, while still others are selected for their aesthetic appeal.

In general, shoe construction typically involves a number of manufacturing operations or steps. Normally, a significant number of manufacturing operations generally results in a more expensive shoe. In a market where competitive price is often desired, there appears to be a need to make shoes in an efficient manner. Conventionally, a shoe construction may involve an upper being stitched to a forepart of an outsole by a hand stitch and the rearpart of the outsole may be attached to the upper by adhesive after a lasting operation. Lasting is typically where a last, an object which simulates a user's foot, is inserted into the upper and the upper is often then pulled taught around the last and secured to a tuck, which is removably attached to the bottom of the last. The tuck generally provides a structure that is adhered to the rearpart of the outsole, which in turn results in the upper being secured to the outsole in the rearpart of the shoe. Without a tuck, it may be difficult to secure the upper to the outsole.

A traditional insole is often wrapped with a wrapper around its peripheral edge to help prevent the edge of the insole from wear. The insole with the wrapper is then typically secured to the tuck or outsole. In a separate operation, a socklining may then be adhered directly to the top of the insole for providing a surface adapted to receive a user's foot because the insole's surface is often coarse.

In addition, cementing components of a shoe, such as the upper to the outsole, often involves a number of manufacturing operations. Typically, there is a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

U.S. Pat. Nos. 4,369,589 to Summey ("Summey") and 3,821,827 to Nadler ("Nadler") appear to disclose a shoe having cement or glue to secure the upper to the midsole or outsole. Summey seems to disclose the pressing and aligning operations as well as user intervention described above. Summey also seems to disclose an insole as a part of the shoe.

What is desired, therefore, is a shoe that may be constructed in a more efficient manner, including reduced manufacturing costs and less manufacturing operations. What is also desired is a shoe that is efficiently manufactured without sacrificing comfort or aesthetic appeal.

SUMMARY OF THE INVENTION

Accordingly, it is an object of the invention to provide a shoe that may be constructed in a more efficient manner.

Another object of the invention is to provide a shoe with reduced manufacturing operations but without sacrificing comfort or aesthetic appeal.

Yet another object of the invention is to provide a shoe that obviates the lasting operation.

A further object of the invention is to minimize operations for providing an insole.

Still another object of the invention is to provide a shoe that obviates a need for a tuck.

These and other objects of the invention are achieved by a shoe having an outsole having a top surface and a lip, where the lip extends around a portion of a periphery of the outsole and is above the top surface. The lip also has an inner surface facing inwardly and an outer surface facing outwardly. An upper is in contact with and secured to the outer surface of the lip. The inner surface of the lip is thereafter secured to the top surface for completing the shoe's attachment of the upper to the outsole.

A stitch may be used for securing the upper to the outer surface of the lip. In addition, the outsole may include a bottom surface and the upper is below the bottom surface of the outsole when the upper is secured to the outer surface of the lip.

The shoe may also include an insole having a bottom surface for contacting the outsole and a top surface adapted to be in direct contact with a user's foot, wherein the shoe is completed upon moving the upper above the top surface of the outsole and the bottom surface of the insole being secured to the outsole.

The shoe may further include a filler placed between the bottom surface of the insole and the top surface of the outsole. In other embodiments, the filler is a cushion.

In some embodiments, the top surface of the insole is a socklining for directly contacting the user's foot. In further embodiments, a cushion is placed between the socklining and the bottom surface of the insole for comforting the user's foot.

In still further embodiments, the socklining extends over and around the cushion and over and around a part of the bottom surface of the insole so that the socklining, cushion, and bottom surface of the insole form a single unit.

Optionally, the insole may be shaped to accommodate the upper being in contact with the outer surface of the lip so that the shoe is completed upon securing the bottom surface of the insole to the outsole.

It is understood that the portion around which the lip extends may or may not extend around the entire periphery, depending upon the type of shoe or appearance desired.

In another embodiment, the shoe includes an outsole having a top surface, a bottom surface, and a lip. The upper is in contact with and secured to the outer surface of the lip where the upper is below the bottom surface of the outsole when the upper is secured to the outer surface of the lip. An insole having a top surface adapted to be in direct contact with a user's foot is placed on top of the top surface of the outsole and wherein the shoe is completed upon moving the upper above the top surface of the outsole.

In another aspect, a method for providing the shoe includes the steps of providing an outsole having a top surface and extending a lip around a portion of a periphery of the outsole and above the top surface, where the lip has an inner surface and an outer surface. The method further includes the steps of inwardly facing the inner surface of the lip and outwardly facing the outer surface of the lip. The method also contacts an upper with the outer surface of the lip and secures the inner surface to the top surface for completing the shoe's attachment of the upper to the outsole.

In some embodiments, the method may include the step of securing the upper to the outer surface of the lip. In further embodiments, the method may also include the step of providing a bottom surface to the outsole and contacting the upper with the outer surface of the lip in a manner such that the upper is below the bottom surface of the outsole.

To complete the shoe, the method includes the step of moving the upper above the top surface of the outsole and placing an insole on the top surface of the outsole. In some embodiments, the insole is a multilayered insole having a bottom surface for contacting the outsole and a top surface adapted to be in direct contact with a user's foot.

In further embodiments, the method places a filler between the top surface of the outsole and the insole. In still further embodiments, the filler is a cushion.

Optionally, the method places a cushion between the top and bottom surfaces of the insole. In other embodiments, the method also extends the top surface of the outsole over and around the cushion and over and around a part of the bottom surface of the insole so that the top surface, cushion, and bottom surface form a single unit.

The invention and its particular features and advantages will become more apparent from the following detailed description considered with reference to the accompanying drawings.

BRIEF DESCRIPTION OF THE DRAWINGS

FIG. 3*b* depicts the upper being secured to the lip, where the upper is inside in.

DETAILED DESCRIPTION OF THE DRAWINGS

Figure 1:
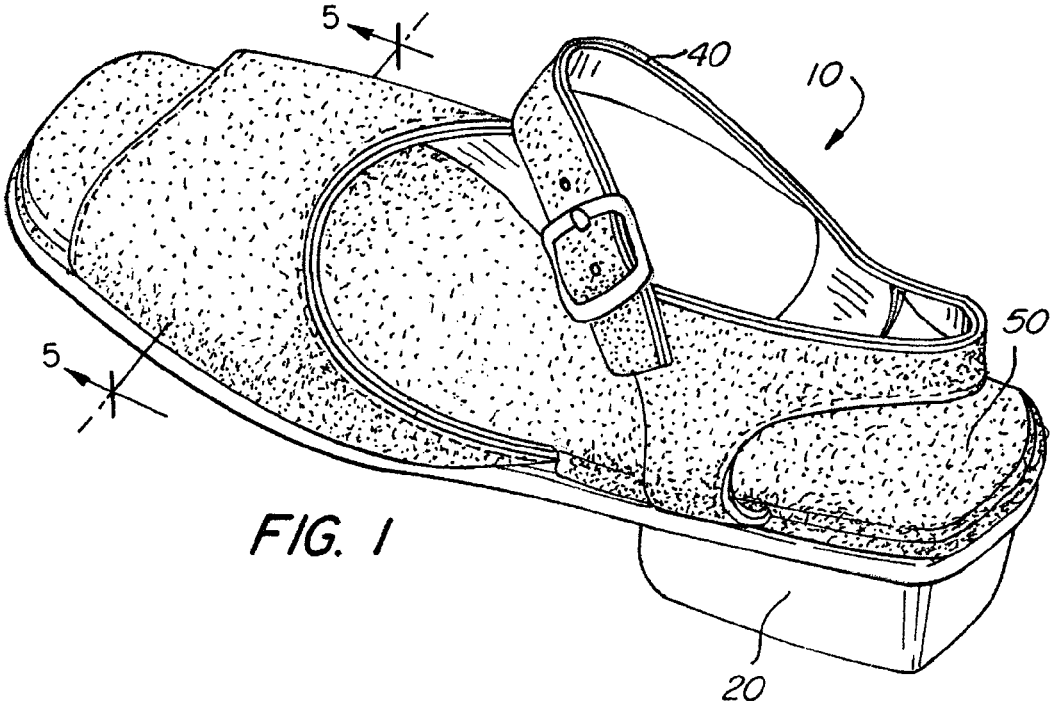
FIG. 1 depicts the shoe in accordance with the invention.

FIG. 1 depicts shoe 10 in accordance with the invention. Shoe 10 includes outsole 20, upper 40, and insole 50. Outsole 20 further includes top surface 22 and lip 24.

Figure 2:
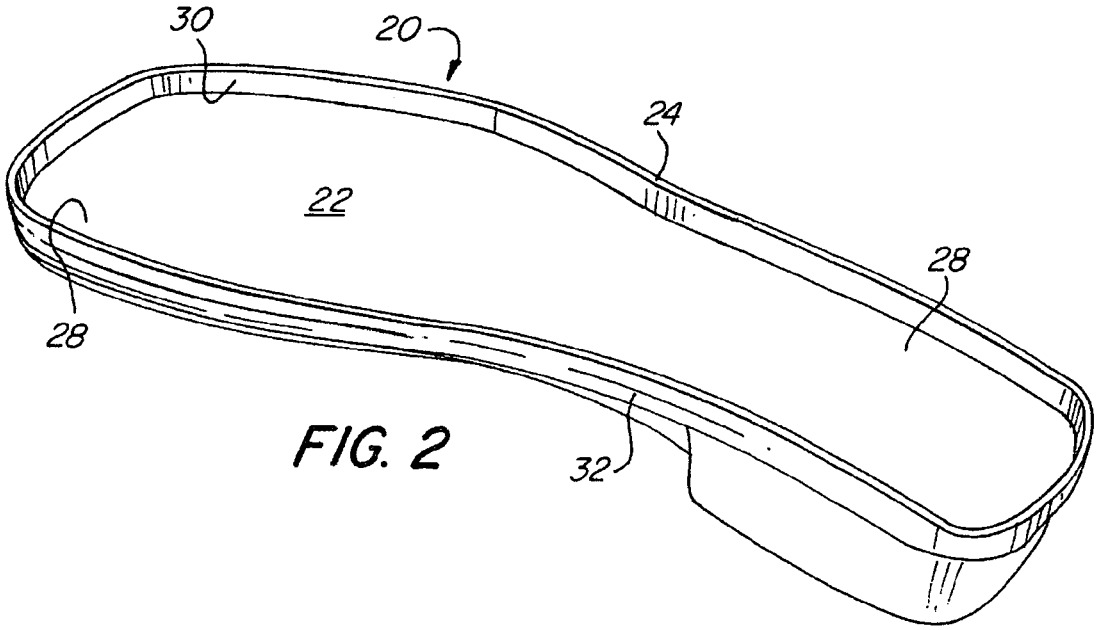
FIG. 2 depicts an outsole of the shoe with a lip extending around a periphery of the shoe.
Figure 6:
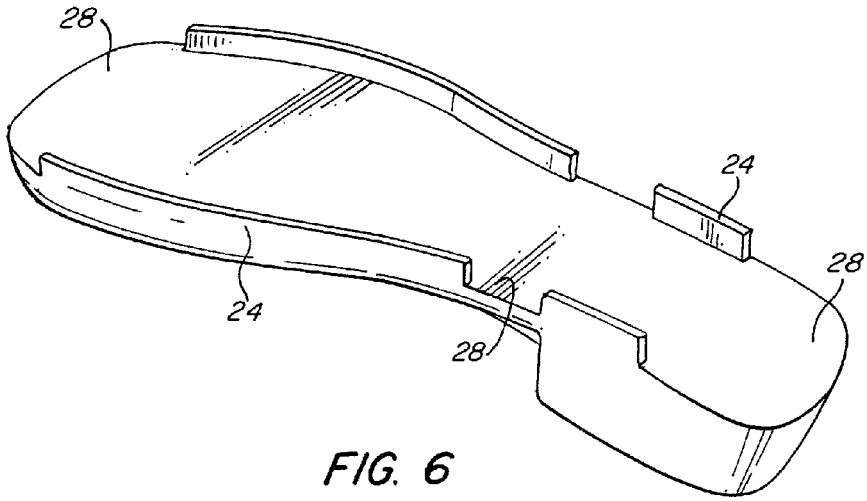
FIG. 6 depicts an alternative embodiment of the lip, where the lip extends around a portion of the periphery of the shoe.

As shown more particularly in FIG. 2, lip 24 extends above top surface 22 and around periphery 28 of outsole 20. Although lip 24 is shown to extend around the entire periphery 28 of outsole 20, this is not a requirement of shoe 10. In another embodiment, shown in FIG. 6, lip 24 extends around a portion of periphery 28.

Lip 24 further includes inner surface 30 facing inwardly and outer surface 32 facing outwardly.

Figure 3A:
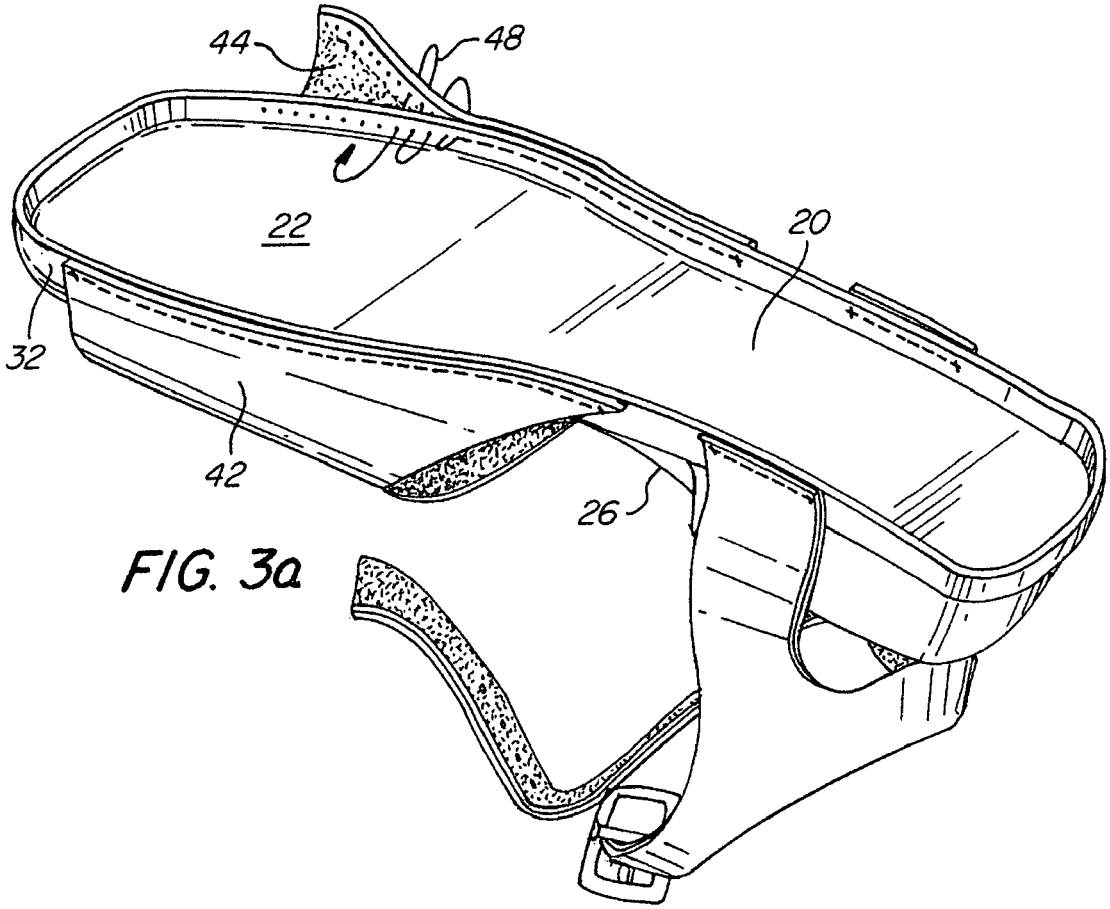
FIG. 3*a* depicts an upper being secured to the lip, where the upper is inside out.

As shown in FIG. 3*a*, upper 40 further includes an inside 42 and an outside 44 where outside 44 of upper 40 is in contact with outer surface 32 of lip 24. Moreover, upper 40 is attached to outer surface 32 of lip 24 in such a manner that upper 40 is located below bottom surface 26 of outsole 20. As shown, upper 40 is inside out, meaning inside 42 is facing outwardly away from top surface 22 of outsole 20. Upper 40 is attached to outer surface 32 of lip 24 by stitch 48, although cement, glue, adhesive, or other known or novel attaching mechanism may be used.

Figure 3B:
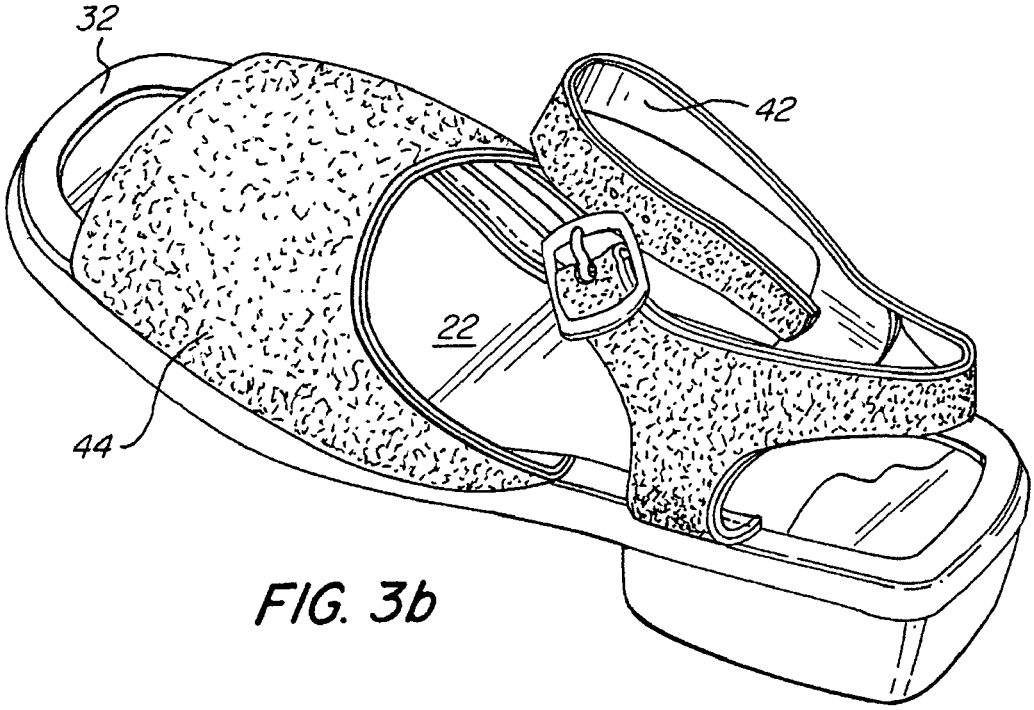
Figure 5:
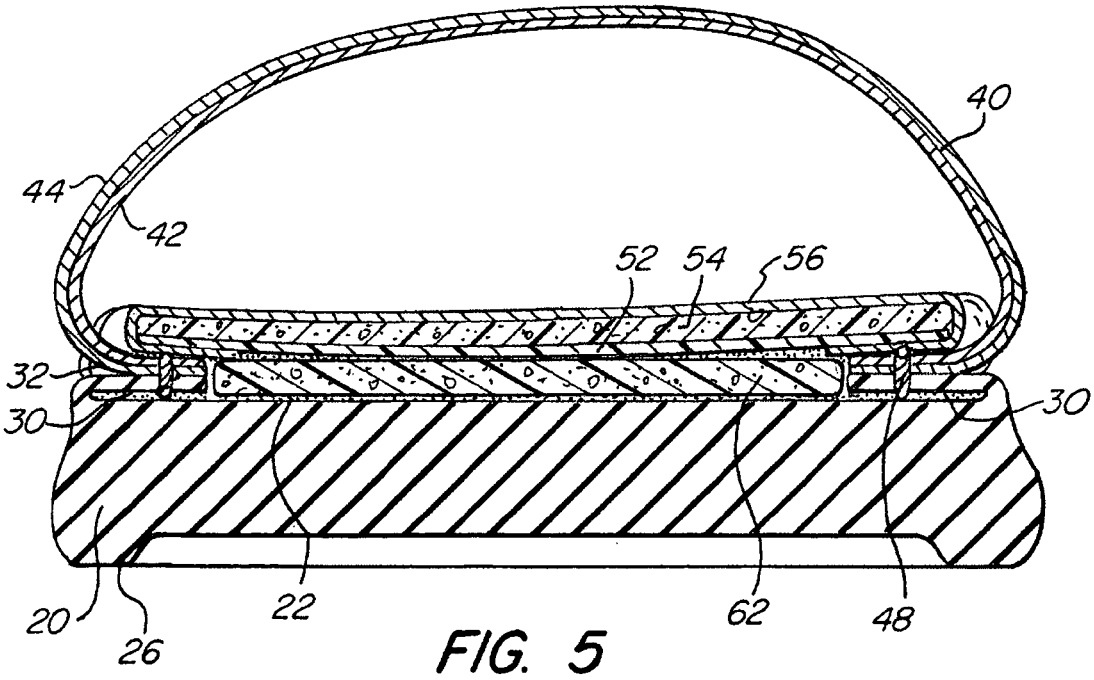
FIG. 5 depicts a cross sectional view of the shoe taken across the forepart of the shoe.

FIG. 3*b* shows upper 40 being turned inside in, meaning inside 42 of upper 40 is facing inwardly and outside 44 of upper 40 is facing outwardly. Turning upper 40 inside in generally entails flipping upper 40 upwardly above top surface 22 of outsole 20 and, as a result, inside 42 of upper 40 automatically faces inwardly. To complete the attachment of upper 40 to outsole 20, inner surface 30 of lip 24 is secured to top surface 22 of outsole 20 (see also FIG. 5). Although FIG. 3*b* shows the entire inner surface 30 being secured to top surface 22, further embodiments where lip 24 extends around a portion of, and not the entire, periphery 28 includes inner surface 30 of lip 24 being secured to top surface 22 at selected areas around periphery 28.

Figure 4:
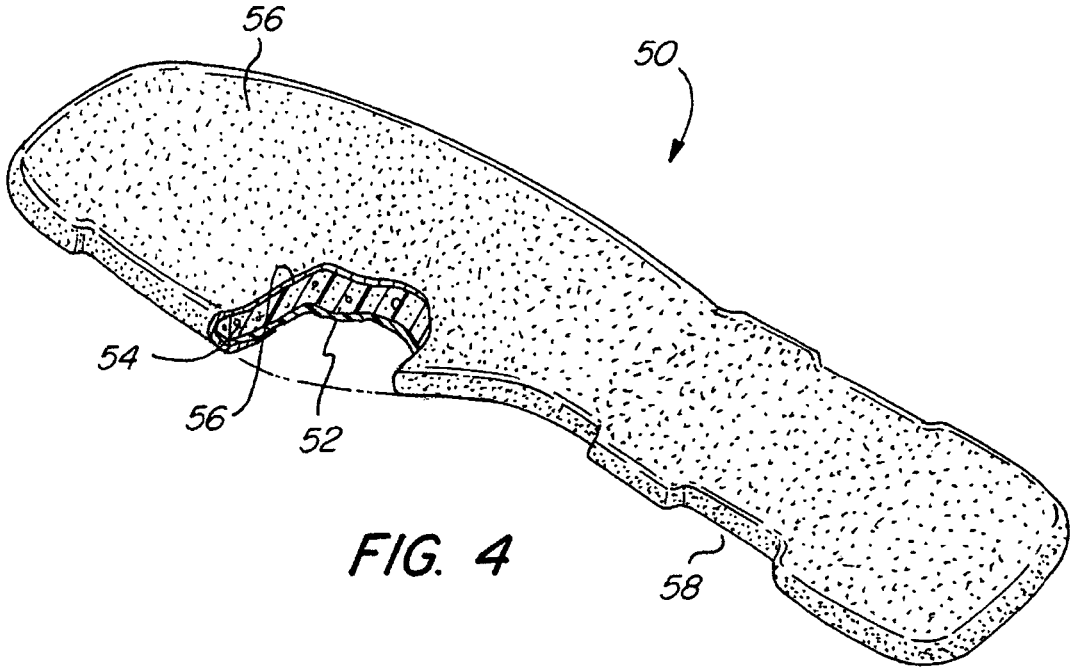
FIG. 4 depicts a multilayered insole to be used with the shoe.

FIG. 4 depicts insole 50 in accordance with the invention. As shown, insole 50 includes multiple layers, such as bottom surface 52 and top surface 56 adapted to be in contact with a user's foot. Optionally, insole 50 may also include cushion 54 placed between bottom surface 52 and top surface 56.

Bottom surface 52 is generally of a sturdy material to withstand wear from walking by the user and also to provide structural integrity when attaching insole 50 to top surface 22 of outsole 20. Top surface 56 of insole 50 is generally of a soft material to provide comfort to the user's foot. In some embodiments, bottom surface 52 of insole 50 is a tuck and top surface 56 of insole 50 is a socklining made of leather.

As shown, top surface 56 of insole 50 is wrapped around a part of bottom surface 52 of insole 50, resulting in top surface 56, bottom surface 52, and cushion 54 being bound as a single unit.

In further embodiments, insole 50 also includes a formed, or shaped, geometry such that, when attached to top surface 22 of outsole 20, insole conforms to the geometry or shape of the now combined upper 40 and outsole 20. In these embodiments, insole 50 includes indentations 58, or notches, to accommodate the attachment of upper 40 and outsole 20. This is more particularly shown in FIGS. 1 and 4.

Optionally, and prior to attaching bottom surface 52 of insole 50 to top surface 22 of outsole 20, filler 62 may be placed on top of top surface 22 to fill the space defined by the thickness of lip 24 being secured to top surface 22 of outsole 20. Filler 62 may be of a cushioning material to add to the comfort of the user's foot.

Upon attaching insole 50 to outsole 20 and turning upper 40 inside in, where inside 42 of upper 40 is facing inwardly, shoe 10 is complete without a lasting operation and without a need for a tuck. Moreover, construction and installation of insole 50 is simplified. In the preferred embodiment, insole 50 is attached to outsole 20 after upper 40 is flipped upwardly above top surface 22 of outsole 20. In alternative embodiments, insole 50 is attached to outsole 20 prior to upper 40 being flipped upwardly above top surface 22 of outsole 20.

Although shoe 10 is preferred to be a sandal, as shown, the invention is applicable to any type or style of shoe.

Figure 7:
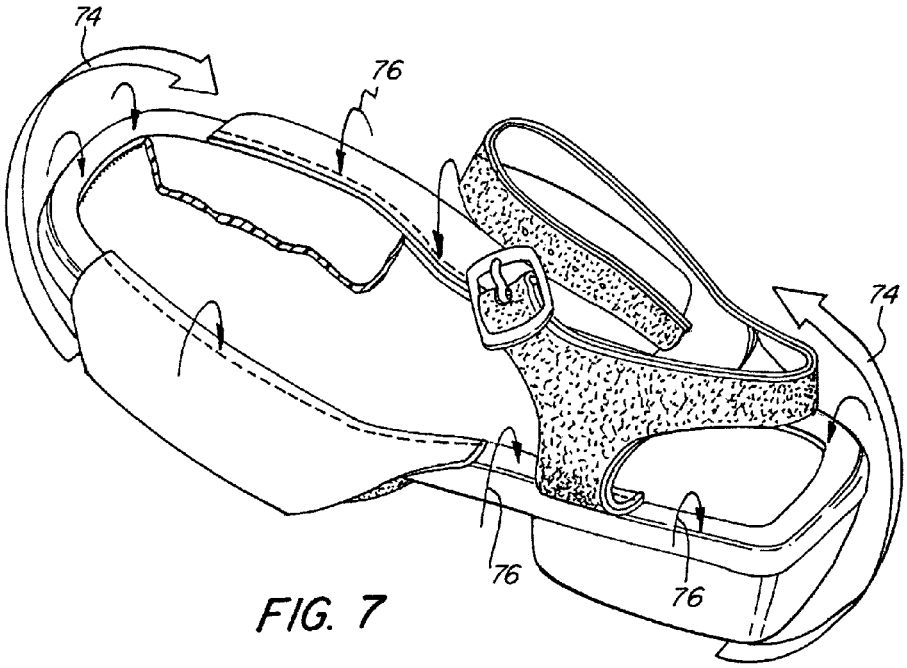
FIG. 7 depicts the act of moving the upper from the position shown in FIG. 3*a* to the position shown in FIG. 3*b*.

FIG. 7 depicts the act of upper 40 being moved, or flipped, from below bottom surface 26 of outsole 20, the position shown in FIG. 3*a*, to above top surface 22 of outsole, the position shown in FIG. 3*b*.

As shown, both the rear part and fore part of upper 40 is moved in the directions shown by arrow 74. To accomplish this act, outsole 20 is preferably of a flexible material, such as thermal plastic rubber, although any flexible material suffices, such as rubber or latex rubber. A flexible material allows outsole 20 to bend or flex in cooperation with the movement of upper 40, which also bends or flexes, in the direction shown by arrow 74. Upper 40 is moved or flipped using all known or novel manners, including being done by hand or machine.

Contemporaneously with moving or flipping upper 40 in direction 74, inner surface 30 of lip 24 is folded down and secured to top surface 22 of outsole 20 in the direction shown by arrow 76. As stated above, this may be done by all known or novel manners for securing inner surface 30 to top surface 22.

Figure 8:
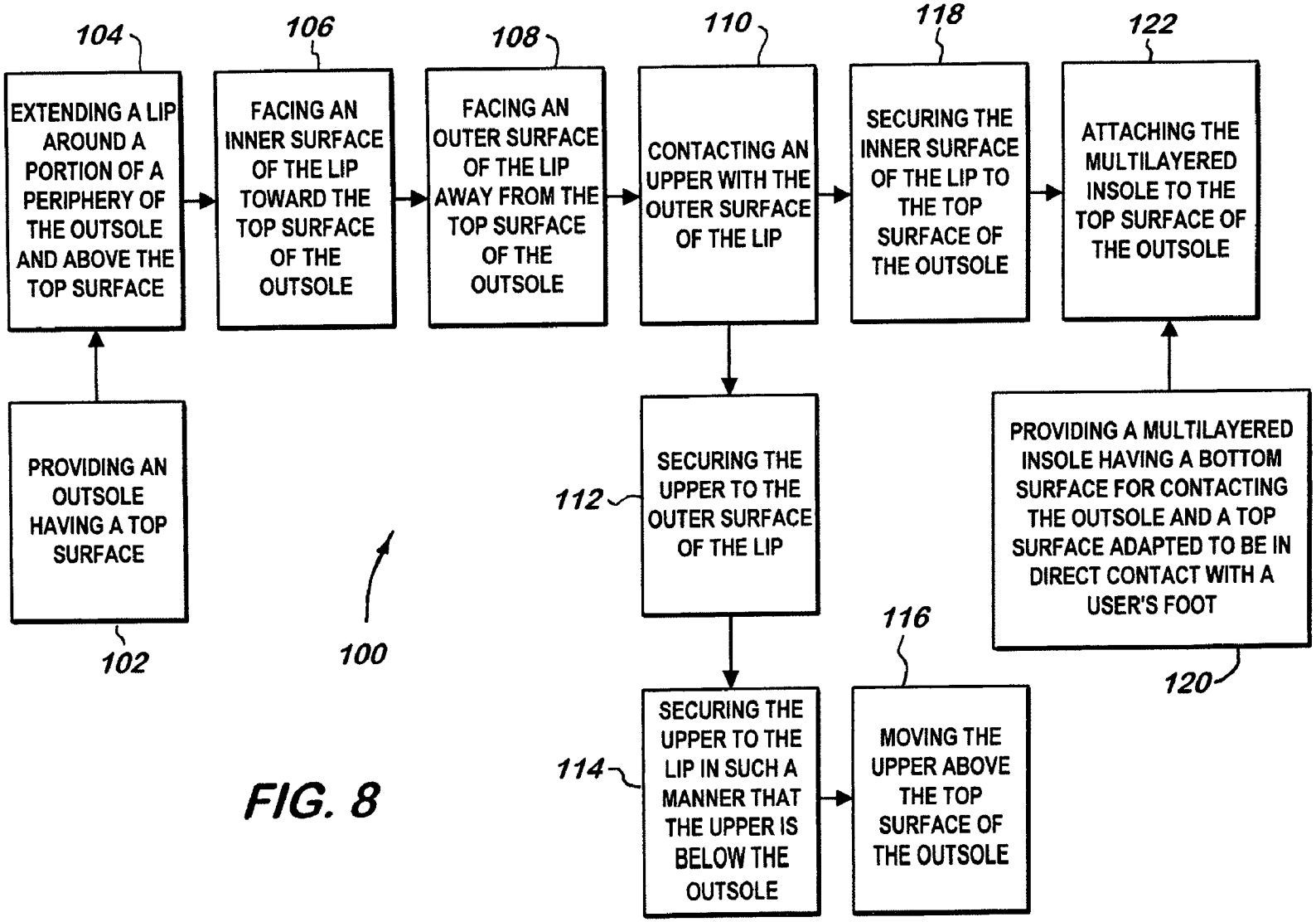
FIG. 8 depicts a method for providing the shoe in accordance with the invention.

FIG. 8 depicts method 100 for providing shoe 10, including the steps of providing 102 an outsole having a top surface and extending 104 a lip around a portion of a periphery of the outsole and above the top surface. Moreover, method 100 includes inwardly facing 106 an inner surface of the lip and outwardly facing 108 an outer surface of the lip.

After the lip is provided, method 100 further includes the step of contacting 110 an upper with the outer surface of the lip. In some embodiments, this may include securing 112 the upper to the outer surface of the lip, such as with a stitch, adhesive, or other adhering mechanism. In further embodiments, method 100 includes securing 114 the upper to the lip in such a manner that the upper is below the outsole's bottom surface. After the upper is secured 114 to the lip and is below the outsole's bottom surface, the attachment of the upper to the lip and outsole is complete. In this position, the upper's inner surface is facing outwardly.

To complete the shoe, the upper would need to be turned inside in, where the inside of the upper is facing inwardly and the outside of the upper is facing outwardly. This is accomplished by securing 118 the inner surface of the lip to the top surface of the outsole and moving 116, or flipping, the upper above the outsole's top surface.

Independent from attaching the upper to the outsole's lip, method 100 also includes providing 120 a multilayered insole having a bottom surface for contacting the outsole and a top surface adapted to be in direct contact with a user's foot. The insole may optionally include a cushion between the top and bottom surfaces of the insole. In addition, the top surface of the insole may extend over and around a part of the insole, resulting in the top surface, optional cushion, and bottom surface of the insole forming a single unit.

To complete the shoe, method 100 includes the step of attaching 122 the multilayered insole to the top surface of the outsole.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A shoe, comprising:

an outsole having a top surface and a lip;

said lip extending around at least a portion of a periphery of said outsole and being above said top surface;

said lip having an inner surface facing inwardly and an outer surface facing outwardly;

an upper in contact with and secured to said outer surface of said lip;

said inner surface being secured to said top surface for completing the shoe's attachment of said upper to said outsole; and an insole placed on said top surface of said outsole and said outer surface of said lip for covering both said top surface and said lip after said inner surface is secured to said top surface.

2. The shoe according to claim 1, wherein said outsole includes a bottom surface and said upper is below said bottom surface of said outsole when said upper is secured to said outer surface of said lip.

3. The shoe according to claim 2, said an insole having a bottom surface for contacting said outsole and a top surface adapted to be in direct contact with a user's foot, wherein the shoe is completed upon moving said upper above said top surface of said outsole and said bottom surface of said insole being secured to said outsole.

4. The shoe according to claim 3, further comprising a filler placed between said bottom surface of said insole and said top surface of said outsole.

5. The shoe according to claim 4, wherein said filler is a cushion.

6. The shoe according to claim 3, wherein said top surface of said insole is a socklining for directly contacting the user's foot.

7. The shoe according to claim 6, further comprising a cushion placed between said socklining and said bottom surface of said insole for comforting the user's foot.

8. The shoe according to claim 7, wherein said socklining extends over and around said cushion and over and around a part of said bottom surface of said insole so that said socklining, said cushion, and said bottom surface of said insole form a single unit.

9. The shoe according to claim 3, wherein said insole is shaped to accommodate said upper being in contact with said outer surface of said lip so that the shoe is completed upon securing said bottom surface of said insole to said outsole.

10. The shoe according to claim 1, further including a stitch for securing said upper to said outer surface of said lip.

11. The shoe according to claim 1, wherein said portion is less than the entire periphery.

12. The shoe according to claim 1, wherein said portion is an entire periphery.

13. A shoe, comprising:

an outsole having a top surface, a bottom surface, and a lip;

said lip extending around a portion of a periphery of said outsole and being above said top surface;

said lip having an inner surface facing inwardly and an outer surface facing outwardly;

an upper in contact with and secured to said outer surface of said lip where said upper is below said bottom surface of said outsole when said upper is secured to said outer surface of said lip;

an insole having a bottom surface for contacting said outsole and a top surface adapted to be in direct contact with a user's foot; said inner surface being secured to said too surface for completing the shoe's attachment of said upper to said outsole;

said insole placed on said top surface of said outsole and said outer surface of said lip for covering both said top surface and said lip after said inner surface is secured to said tip surface; and wherein said upper is moved above said top surface of said outsole and said bottom surface of said insole being secured to said outsole.

14. A method for providing a shoe, comprising the steps of:

providing an outsole having a top surface;

extending a lip around a portion of a periphery of the outsole and above the top surface;

inwardly facing an inner surface of the lip and outwardly facing an outer surface of the lip;

contacting an upper with the outer surface of the lip;

securing the inner surface of the lip to the top surface of the outsole for completing the shoe's attachment of the upper to the outsole; and placing an insole on the top surface and the outer surface for covering both the top and outer surfaces after the inner surface is secured to the top surface.

15. The method according to claim 14, further comprising the step of securing the upper to the outer surface of the lip.

16. The method according to claim 14, further comprising the step of providing a bottom surface to the outsole and contacting the upper with the outer surface of the lip in a manner such that the upper is below the bottom surface of the outsole.

17. The method according to claim 16, further comprising the step of moving the upper above the top surface of the outsole.

18. The method according to claim 14, further comprising the step of providing a multilayered insole having a bottom surface for contacting the outsole and a top surface adapted to be in direct contact with a user's foot.

19. The method according to claim 18, further comprising the step of placing a filler between the top surface of the outsole and the insole.

20. The method according to claim 18, further comprising the step of placing a cushion between the top and bottom surfaces of the insole.

21. The method according to claim 20, further comprising the step of extending the top surface of the outsole over and around the cushion and over and around a part of the bottom surface of the insole so that the socklining, the cushion, and the bottom surface of the insole form a single unit.

* * * * *